US005954484A

United States Patent [19]

Strate

[11] Patent Number: 5,954,484

[45] Date of Patent: Sep. 21, 1999

[54] SEWAGE LIFTING STATION

[75] Inventor: Wilfried Strate, Laatzen, Germany

[73] Assignee: STRATE Technologie für Abwasser GmbH, Sarstedt, Germany

[21] Appl. No.: 08/986,814

[22] Filed: Dec. 8, 1997

[30] Foreign Application Priority Data

Dec. 6, 1996 [DE] Germany ..... 196 50 625

[51] Int. Cl.[6] ..... F04B 23/04; F04B 41/06

[52] U.S. Cl. ..... 417/427; 417/515; 417/900; 417/295; 417/288; 137/625.27; 137/609

[58] Field of Search ..... 417/427, 515, 417/900, 103, 92, 295, 286; 137/864, 867, 868, 636.1, 625.27, 870

[56] References Cited

U.S. PATENT DOCUMENTS

| | | | |
|---|---|---|---|
| 2,494,633 | 1/1950 | Schlicksupp | 277/13 |
| 3,530,886 | 9/1970 | Zoya | 137/609 |
| 3,884,266 | 5/1975 | Kondo | 137/625.27 |
| 4,005,726 | 2/1977 | Fowler | 137/119 |

FOREIGN PATENT DOCUMENTS 36 07353 9/1987 Germany .

*Primary Examiner*—Charles G. Freay
*Assistant Examiner*—Paul L. Ratcliffe
*Attorney, Agent, or Firm*—Collard & Roe P.C.

[57] ABSTRACT

A sewage lifting station having at least two solid waste collection chambers for receiving pumped solid waste-contaminated sewage. The station has a collection tank for receiving pre-treated waste water flowing from the solid waste collection chambers via connection pipes. Each solid waste collection chamber is connected to a pump to empty the collection tank via one of the connection pipes and solid waste collection chambers to pump the current of sewage into a pressure pipeline. There is a closing device connected to each connection pipe to selectively close an exit orifice in the connection pipe and open a connection to an operating pump to drain the collection tank. A control device alternately closes and opens the exit orifices with the closing devices so that an exit orifice allocated to an operating pump is closed and an exit orifice allocated to a non-operating pump is simultaneously and automatically opened. The present invention ensures precise opening and closing of the exit orifices, thus ensuring efficient operation of the sewage lifting station.

7 Claims, 4 Drawing Sheets

10
12
14
15
16
17
18
20
22
24
26
28
30
32
34
36A
36B
48
A
B
C
E

SEWAGE LIFTING STATION

BACKGROUND OF THE INVENTION

1. Field of the Invention

This invention relates to a sewage lifting station. In particular, the invention relates to a sewage lifting station having a closing device whose operation is dependent on the operation of the pump.

2. Description of the Prior Art

Sewage lifting stations have been known, as shown in German Patent 36 07 353. The known sewage lifting stations have two solid waste collection chambers into which the waste water carrying the solid waste is fed. There is also a common collection tank for the waste water that has been freed of solid waste and pre-treated, which flows from each solid waste collection chamber into the main collection tank. Each solid waste chamber is equipped with a pump to drain each collection chamber. The pump pumps and moves a stream of waste water through the individual solid waste collection chamber and into a pressurized pipeline.

With this known sewage lifting station, a closing device is allocated to each connecting pipe and is designed to open or clear an exit orifice in the connecting pipe to the collection tank. The device also at least partially cuts off the connection to the pump in question so that the pre-treated waste water, either in its entirety or the greater part of it, may flow into the collecting tank through the exit orifice and not through the pump. Whenever centrifugal pumps are used, there will be no damage if a small portion of the waste water flows through the pump and rinses it clean.

Furthermore, the closing device is designed to block the exit orifice and close it whenever the pump is in operation draining the collection tank. The closed exit orifice ensures that the entire waste water volume handled by the pump ends up in the pressure pipeline and not pumped back into the collection tank.

In the known sewage lifting station, the closing device is a spring-loaded backflow regulator door which springs into a position where it partially blocks the connecting pipe to the pump. Simultaneously, the exit orifice in the connecting pipe leading directly into the collection tank is unblocked. Whenever the collection tank is filled and the level-controlled pump is switched on, the backflow regulator door is moved against the spring power by the force of the sewage into a position where it closes the exit orifice in the connecting pipe.

The actuation of the known closing device in the shape of a backflow regulator door is thus achieved by the force of the spring and the force of the hydraulic current of waste water.

In actual operation, the known sewage lifting station has performed satisfactorily. However, during operation, the backflow regulator door unit bangs loudly whenever the backflow door closes the exit orifice in the connecting pipeline. Such banging may cause mechanical vibration, which may travel along the pipelines and may be perceived as "loud bangs".

Under extreme operational conditions of the sewage lifting station, e.g. during cloudbursts producing large accumulations of water, undefined switching modes of the backflow door may occur. This may be traced back to the setting of the spring pressure acting onto the backflow shutter at that time. Moreover, the design of the known sewage lifting station may be comparatively expensive because of the large number of necessary individual parts, as well as the necessary adjustment work for the restoring force of the spring.

SUMMARY OF THE INVENTION

It is, therefore, an object of the invention to create an improved sewage lifting station which also guarantees precise opening and closing of the exit orifices even under overload conditions with large accumulations of waste water. It is another object of the invention to provide an improved sewage lifting station that is inexpensive to manufacture.

The invention comprises a positive control system which ensures that the exit orifices in the connection pipes are either opened or closed by the closing devices, depending upon the operational mode at that time. This ensures that the exit orifice allocated to the operational pump is closed, while the other exit orifice not allocated to the operational pump is automatically opened.

This results in clearly defined closing positions of the closing device, even with large-diameter orifices. The invention also ensures that the waste water can freely and completely flow from the collection tank via an opened exit orifice and that the exit orifice will not be closed until the pump in question is switched on. This also guarantees added dependability of the entire operation of the sewage lifting station, in that the opening of one of the exit orifices automatically causes the closing of the other. The opened exit orifice creates a bypass to the allocated pump, which may be a centrifugal pump or a positive-displacement pump.

Whenever a centrifugal pump is used, part of the inflowing waste water may flow through the pump itself, thereby rinsing it clean and washing off possible deposits at the impellers. In contrast, water will not be able to flow into the collection tank through a positive-displacement pump. Thus, with a positive-displacement pump, the entire amount of pre-cleaned sewage ends up in the collection tank via the bypass and the exit orifice.

The advantage of making the controls dependent on the prevalent operational mode of the pump is that the closing devices are no longer exclusively pumping medium-controlled. Thus, even with smaller amounts of sewage, precise and clearly defined closing positions can be obtained. This is especially advantageous whenever positive-displacement pumps are used, which are usually preferred in the case of comparatively small accumulations of waste water because of their superior performance.

In a preferred embodiment of the invention, the devices are designed as two balls each contained in a ball cage attached to the connecting pipe which has an exit orifice. Using a ball is advantageous because there are no sharp edges on its spherical surface. The ball can freely move inside the ball cage and is constantly washed in the waste water so that encrustations can be rinsed off. This also tends to prolong the service life of the closing device. The two balls are preferably mechanically coupled together. This ensures the intended positive control which guarantees that one exit orifice is always automatically closed whenever the other exit orifice is opened.

In an advantageous embodiment, a common rocker arm connects the two balls. The rocker arm can be actuated by either of the two balls and swiveled around a hinge point into one final position. The ball blocking the exit orifice actuates the rocker arm which, as a result, subsequently reacts automatically and simultaneously onto the other ball, causing the other ball to unblock the allocated exit orifice.

In another embodiment, the exit orifices are preferably arranged opposite each other and the two balls are rigidly connected via a rod, so that the ball blocking an exit orifice acts onto the other ball via the rod to open the allocated exit orifice.

Such arrangements are especially advantageous for larger volumes of sewage which, because of their more powerful hydraulic currents, are able to transpose the balls more accurately into their respective closing positions. These embodiments are, therefore, preferably used whenever the pumps are of the centrifugal type, which is used for comparatively larger accumulations of waste water.

In a further embodiment of the invention, a control device acts on the balls via the common rocker arm. The device becomes active whenever one of the two pumps is switched on and positively reacts on the two balls after one pump is started. The one ball allocated to the closed exit orifice while the collection tank is pumped dry is lifted out of its position and the other ball is simultaneously forced into the other position, which unblocks or frees the other exit orifice and is held there. Here, the actuation of the balls is completely independent of the flow rate or of the amount of waste water. Thus, even with smaller amounts of sewage, precise operation is guaranteed. In a further advantageous embodiment of the invention, the pumps are of the positive-displacement type, which possess a high degree of effectiveness. However, in contrast to centrifugal pumps, these pumps are mostly used for smaller waste water volumes. The precise and accurate operation of the sewage lifting station is also guaranteed in those situations, and the positive control ensures that one exit orifice is open at a time while the other exit orifice is automatically closed.

In a further suitable embodiment of the invention, the balls are made of plastic, which has proven to be especially durable, and have an extended service life. The balls may be hollow and filled with ballast material in order to influence the specific weight of the balls. The various weights may be employed in order to optimize the closing behavior of the balls.

BRIEF DESCRIPTION OF THE DRAWINGS

The above and other objects, advantages and features of this invention will become more apparent from the following detailed description of certain now preferred embodiments thereof, taken in conjunction with the accompanying drawing, wherein.

DETAILED DESCRIPTION OF THE PREFERRED EMBODIMENTS

Figure 1:
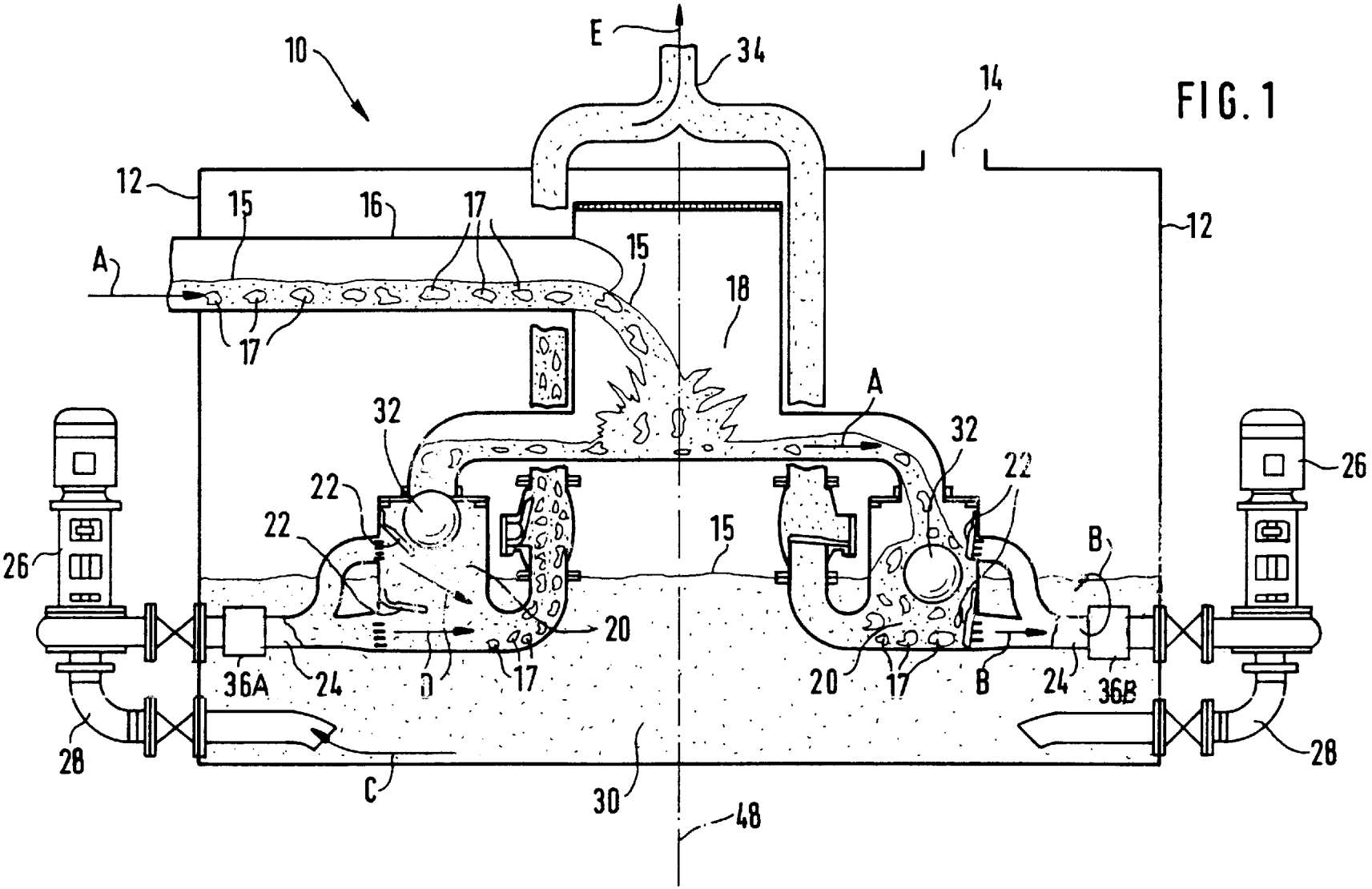
FIG. 1 shows a sectional view of a sewage lifting station with two solid waste collection tanks.

For the purpose of increased clarity, the drawing in accordance with FIG. 1 shows a sewage lifting station 10 in a display spread along the line of symmetry 48. In practical application, the parts to the left and the right of the line of symmetry 48—in relation to the plane of projection—are actually located one above the other. Sewage lifting station 10 includes a housing 12 with a ventilating port 14. Within housing 12, there are two solid waste collection chambers 20 as well as a closed collection tank 30. To each solid waste collection chamber 20, a pump 26 is allocated outside housing 12.

Via a feed pipe 16, sewage 15 loaded with solid waste 17 flows via a funnel-shaped distributor unit 18 into solid waste collection chambers 20. Each solid waste collection chamber 20 features two separation doors 22 through which solid waste 17 is retained inside solid waste collector chambers 20. The water freed of solid waste 17 is free to flow unhindered into connecting pipes 24. Furthermore, each solid waste collector chamber 20 has a floating ball 32 which serves as a shutoff device.

A closing device is made of parts 36A and 36B, which are allocated to each connecting pipeline 24, the precise design of which will be explained in detail below with reference to FIGS. 2–7. In the right-hand half of FIG. 1, the filling process of collection tank 30 during the inflow of sewage is indicated by means of arrow B. The closing device shuts off the path towards right-hand pump 26, at least predominantly, so that the pre-treated sewage from connecting pipeline 24 is led directly into collection tank 30. A bypass parallel to pump 26 is opened, and the pre-treated waste water will not flow into collection tank 30 through switched-off pump 26, but directly into abovementioned tank 30.

Whenever collection tank 30 is filled and the waste water inside has reached a certain level, one of the two level-controlled pumps 26 is activated to drain collection tank 30 and pump waste water 15 via allocated solid waste collection chamber 20 into a pressure pipe 34. This process is depicted in the left-hand part of FIG. 1 and further indicated by arrows C, D and E.

With the pump activated, the waste water is pumped via a lower pipeline in the direction of arrow C, through pump 26 connecting pipe 24, and passes through solid waste collection chamber 20 into pressure pipe 34. Closing device 36A opens the connection between connecting pipe 24 and pump 26, and simultaneously shuts off the access to collection tank 30. The orifice of the solid waste collection chamber leading into feed line 16 is closed by floating ball 32. While waste water 15 is pumped through solid waste collection chamber 20 and into pressure pipe 34, solid waste 17 retained in solid waste collection chamber 17 is carried along and ends up in the pressure pipe. The waste water simultaneously flowing in during this process flows through the right-hand solid waste collector chamber 20 and into collection tank 30.

Figure 2:
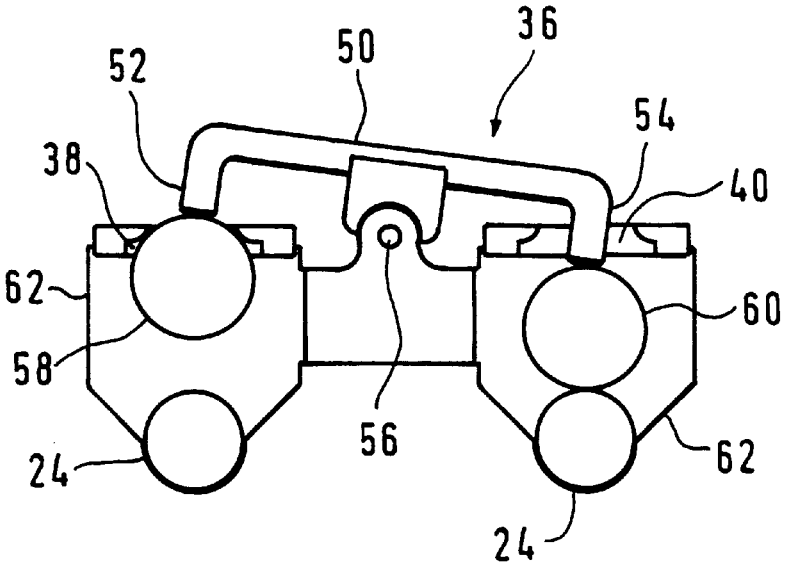
FIGS. 2 and 3 show a side view of a preferred closing device according to the invention in two different working positions.
Figure 3:
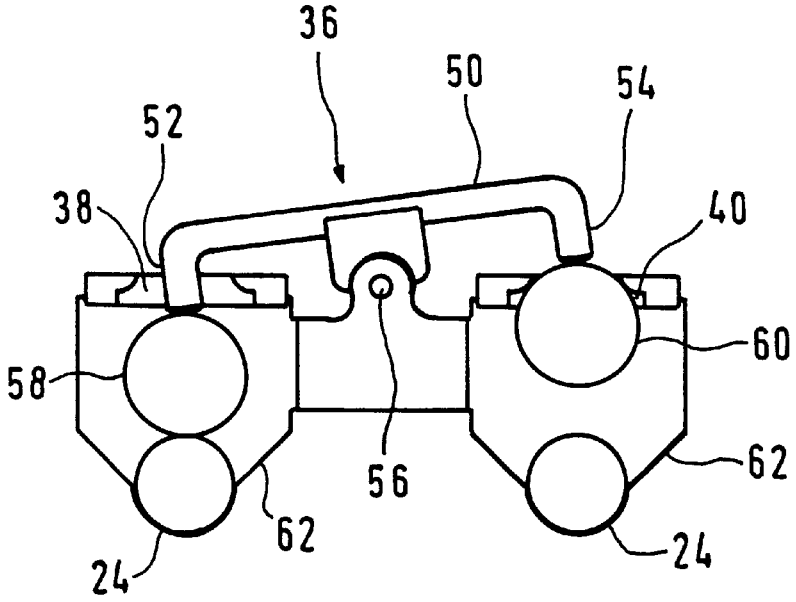

FIGS. 2 and 3 show a detailed arrangement of a closing device 36 having a forced or positive control device. Closing device 36 is formed by two balls 58 and 60. Each ball is arranged within a ball housing 62 so that it can move up and down vertically. At the bottom, ball housing 62 is connected to connecting pipe 24 and, at its upper end, has an exit orifice 38, 40. The flow from connecting pipe 24 through ball housing 62 towards collection tank 20 is either opened or closed by means of balls 58, 60. A rocker arm 50 has actuator arms 52 and 54 allocated to balls 58, 60. Rocker arm 50 pivots around a hinge point 56 and forms a mechanical coupling between both balls 58, 60. The mechanical coupling between balls 58, 60 mandates compulsory control of the system. If the pump allocated to the left-hand connecting pipe (not shown here) is in operation and is pumping sewage from the collection tank, ball 58 will move upward and close exit orifice 38. Through contact with actuator arm 52, rocker arm 50 pivots and the other actuator arm 54 moves the other ball 60 downward. Thus, in the right-hand ball housing 62, exit orifice 40 leading into the collection tank is forcedly and automatically opened. FIG. 3 shows the other possible operational position. Here, the pump allocated to the right-hand connecting pipe 24 is in operation while ball 58 is moved downward, via seesaw and actuator arm 52, and thus the left-hand exit orifice in the left-hand ball housing 62 is opened. Thus, whenever one of the two exit orifices is closed, the other exit orifice is forcibly and automatically opened.

Figure 4:
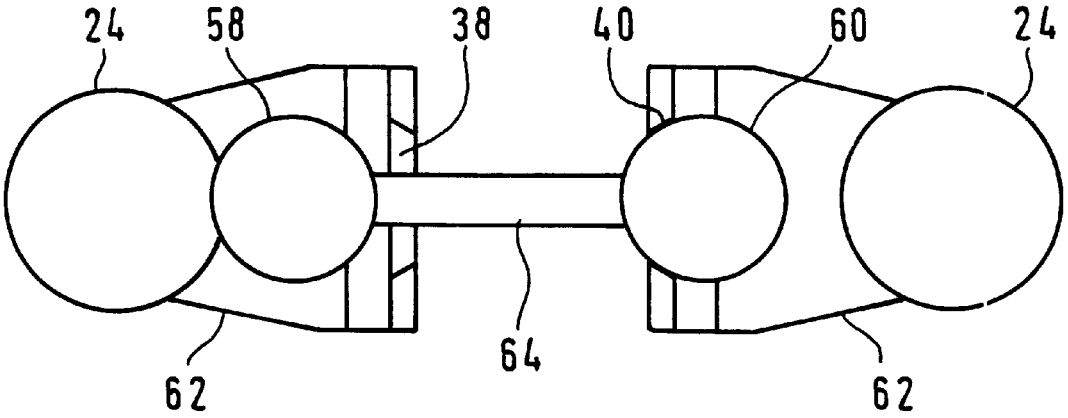
FIGS. 4 and 5 show side views of a further embodiment of a closing device according to the invention in two different working positions.
Figure 5:
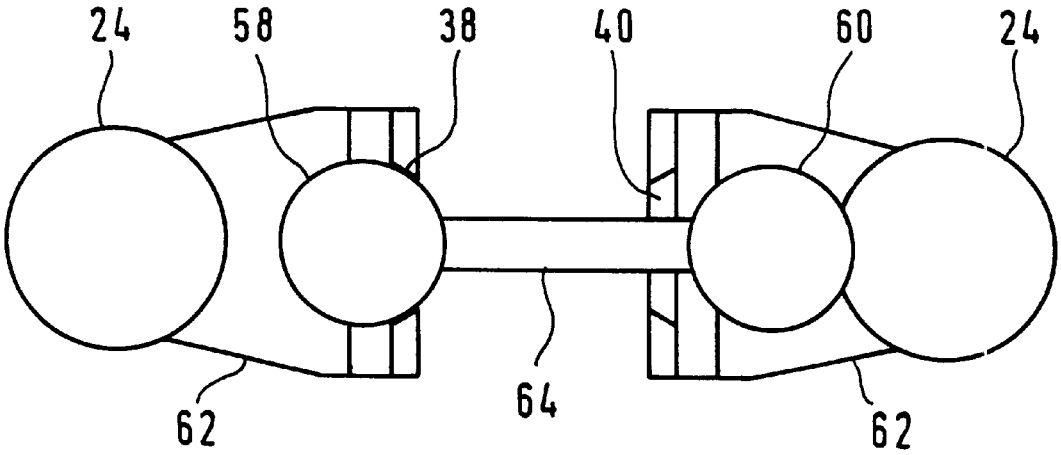

A further embodiment is shown in FIGS. 4 and 5. Here, exit orifices 38, 40 are arranged opposite each other at a certain distance, and the two balls 58 and 60 are rigidly connected by a rod 64. The various operational positions in FIGS. 4 and 5 clearly show the rigid connection via rod 64, which ensures that, whenever exit orifice 40 is closed, the other exit orifice 38 is automatically opened (FIG. 4) and vice versa (FIG. 5).

The embodiments shown in FIGS. 2–5 are preferably used whenever centrifugal pumps are employed and large volume flows or large amounts of water must be handled. This means that in the embodiment shown in FIG. 3, waste water flowing via the left-hand connection pipe 24 can flow through open exit orifice 38 into the collection tank. Simultaneously, part of the waste water may flow through the centrifugal pump into the collection tank to wash the impeller of the centrifugal pump clean of possible sedimentation. Because of the large volume of water, balls 58, 60 are sufficiently influenced by the hydraulic current of the waste water so that the one ball, in the manner described above, affects the other ball via seesaw 50.

Figure 7:
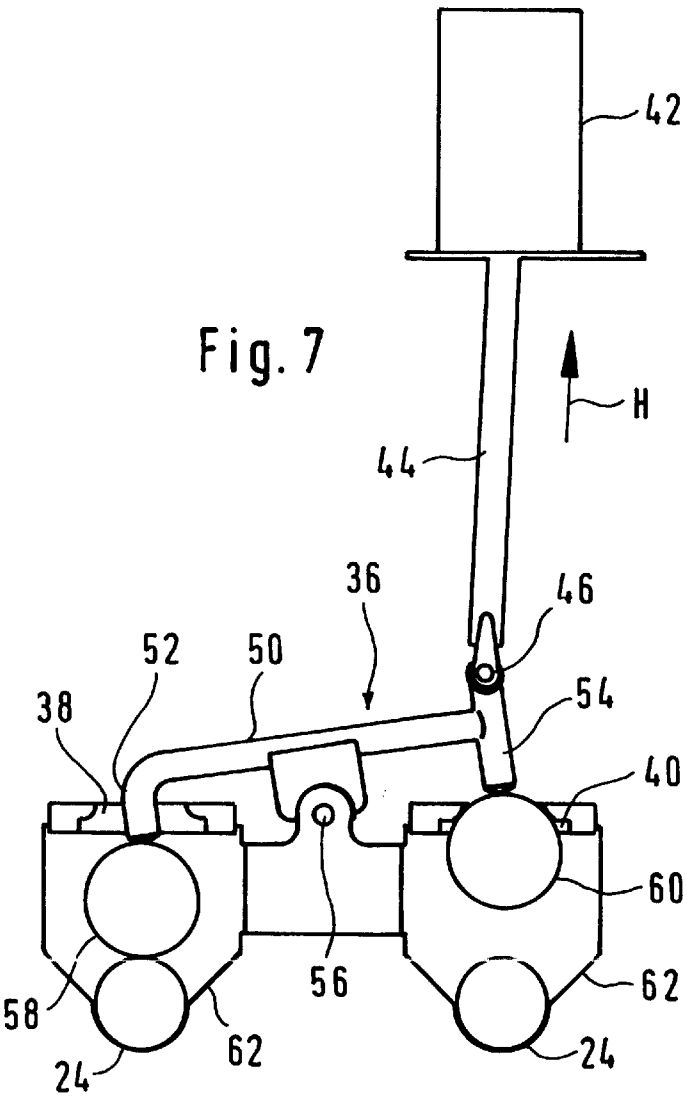
FIGS. 6 and 7 show side views of a different embodiment of a closing device according to the invention in a first and second working position.
Figure 6:
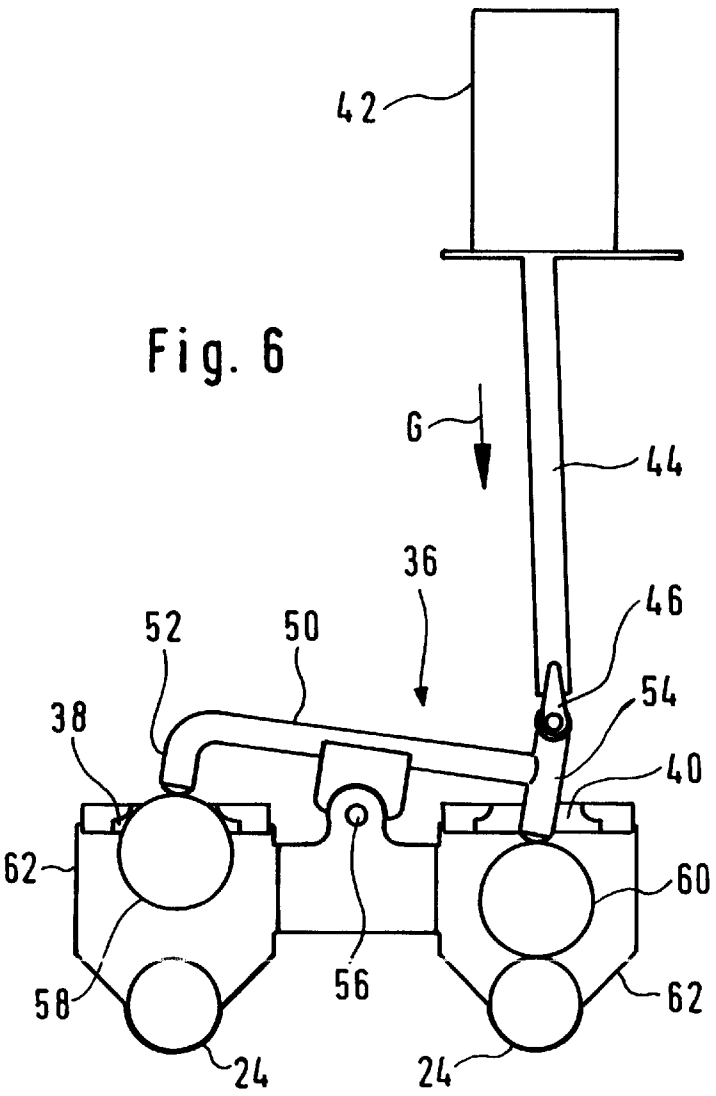

In the embodiments shown in FIGS. 6 and 7 of a closing device 36, balls 58, 60 are accordingly controlled by a control device 42. Control device 42 has a lower push rod 44 connected to seesaw 50 or actuator arm 54, respectively, via a hinge point 46. Whenever either one of the pumps is actuated, push rod 44 is either moved downwards in the direction of arrow G (FIG. 6) or upwards in the direction of arrow H (FIG. 7). Seesaw 50 automatically assumes one of the two positions shown in FIGS. 6 and 7, where its actuator arms act on balls 58, 60 and will either open or close exit orifices 38, 40. Because of the automatic control, one exit orifice 38 or 40 is closed, while the other exit orifice 38 or 40 is automatically opened.

The above embodiment is preferably used with positive-displacement pumps when the amounts of waste water are not very large. Without control device 42 and pushrod 44, there could be a risk of balls 58, 60 not assuming their proper closing positions because of the comparatively insignificant flow rate of the sewage. However, this can be avoided by using control device 42 which is actuated every time one of the pumps is switched on.

Also in FIGS. 6 and 7, with exit orifice 40 or 38 opened, the connection to the pump in question is not fully closed. This, however, is unimportant because the particular design of the positive displacement pump prevents waste water from flowing through an inactive pump.

All embodiments shown are based on the idea that balls 58, 60 will reverse each other via rocker arm 50. In FIGS. 2–5, this is achieved by control by the medium, while in FIGS. 6 and 7, it is achieved through the action of control device 42.

While several embodiments of the present invention have been shown and described, it is to be understood that many changes and modifications may be made thereunto without departing from the spirit and scope of the invention as defined in the appended claims.

What is claimed is:

1. A sewage lifting station having at least two solid waste collection chambers for receiving pumped solid waste-contaminated sewage, said station having a collection tank for receiving pre-treated waste water flowing from the solid waste collection chambers via connection pipes, wherein each solid waste collection chamber is connected to a pump to empty the collection tank via one of the connection pipes and solid waste collection chambers to pump the current of sewage into a pressure pipeline, comprising:

a closing device comprising a ball contained in a ball cage connected to each connection pipe to selectively close an exit orifice within the ball cage and open a connection to an operating pump to drain the collection tank; and a control device that alternately closes and opens said exit orifices with the closing device so that an exit orifice allocated to an operating pump is closed and an exit orifice allocated to a non-operating pump is simultaneously and automatically opened.

2. The lifting station according to claim 1, wherein said balls are mechanically coupled together.

3. The lifting station according to claim 2, wherein said closing device includes a common rocker arm connecting said balls, said rocker arm being pivotable around a hinge-point by either ball into a final position so that a ball closing an exit orifice actuates the rocker arm and causes the other ball to open an exit orifice.

4. The lifting station according to claim 2, wherein the exit orifices are arranged opposite each other and wherein said balls are rigidly connected by a rod so that a ball closing one exit orifice acts on the rod and causes the other ball to open the other exit orifice.

5. The lifting station according to claim 2, wherein the control device is actuated upon turning on one of the pumps, said control device causing one of said balls to close an exit causing the other of said balls to open the other exit orifice.

6. The lifting station according to claim 5, wherein the pumps are positive-displacement pumps.

7. The lifting station according to claim 1, wherein the balls are made of plastic.

* * * * *